United States Patent [19]

Beard et al.

[11] Patent Number: 4,729,175

[45] Date of Patent: Mar. 8, 1988

[54] ULTRASONIC PRESS DRYING OF PAPERBOARD

[75] Inventors: Ralph E. Beard; Donald F. Hiscock, both of Columbus, Ohio; Kazuo Horita, Wheaton, Ill.; Joseph A. Jacomet, Galena; Nagabhusan Senapati, Dublin, both of Ohio; Roger P. Hagan, Fernandina Beach, Fla.

[73] Assignee: Container Corporation of America, Alton, Ill.

[21] Appl. No.: 20,539

[22] Filed: Mar. 2, 1987

[51] Int. Cl.[4] ..... F26B 20/00

[52] U.S. Cl. ..... 34/1; 34/146; 34/69; 34/70

[58] Field of Search ..... 34/1, 68, 164, 143, 34/146, 144, 69, 70; 219/10.81

[56] References Cited

U.S. PATENT DOCUMENTS 3,999,302 12/1976 Candor ..... 34/164

*Primary Examiner*—Larry I. Schwartz

*Attorney, Agent, or Firm*—Richard W. Carpenter

[57] ABSTRACT

Method and apparatus for applying ultrasonic energy to a continuously moving web of paperboard at the same time it is being press-dried by being subjected to pressure and heat.

10 Claims, 3 Drawing Figures

ULTRASONIC PRESS DRYING OF PAPERBOARD

BACKGROUND OF THE INVENTION

1. Field of the Invention:

This invention relates to an improved method for the production of paperboard by the combined use of press-drying and ultrasonic energy to enhance the removal of moisture from and increase the density of the paperboard.

2. Description of the Prior Art:

A prior art search directed to the subject matter of this application in the U.S. Patent and Trademark Office disclosed the following U.S. Pat. Nos.: 838,616; 1,347,723; 1,479,265; 2,122,376; 2,135,763; 2,209,761; 2,624,245; 2,907,690; 3,057,075; 3,148,108; 3,162,568; 3,319,352; 3,354,035; 3,515,633; 3,655,507; 3,691,010; 3,799,052; 3,973,483; 4,011,034; 4,040,899; 4,139,410; 4,163,688; 4,324,613; 4,351,700; 4,384,514; 4,391,670; 4,506,456.

None of the prior art patents uncovered in the search discloses the simultaneous use of press-drying and ultrasonic energy to form paperboard.

SUMMARY OF THE INVENTION

It is a primary object of the invention to provide an improved method of making paperboard which increases strength properties of the paperboard.

A more specific object of the invention is the provision of a method of making paperboard that combines the use of pressdrying and ultrasonic energy.

These and other objects of the invention will be apparent from an examination of the following description and drawings.

Figure 1:
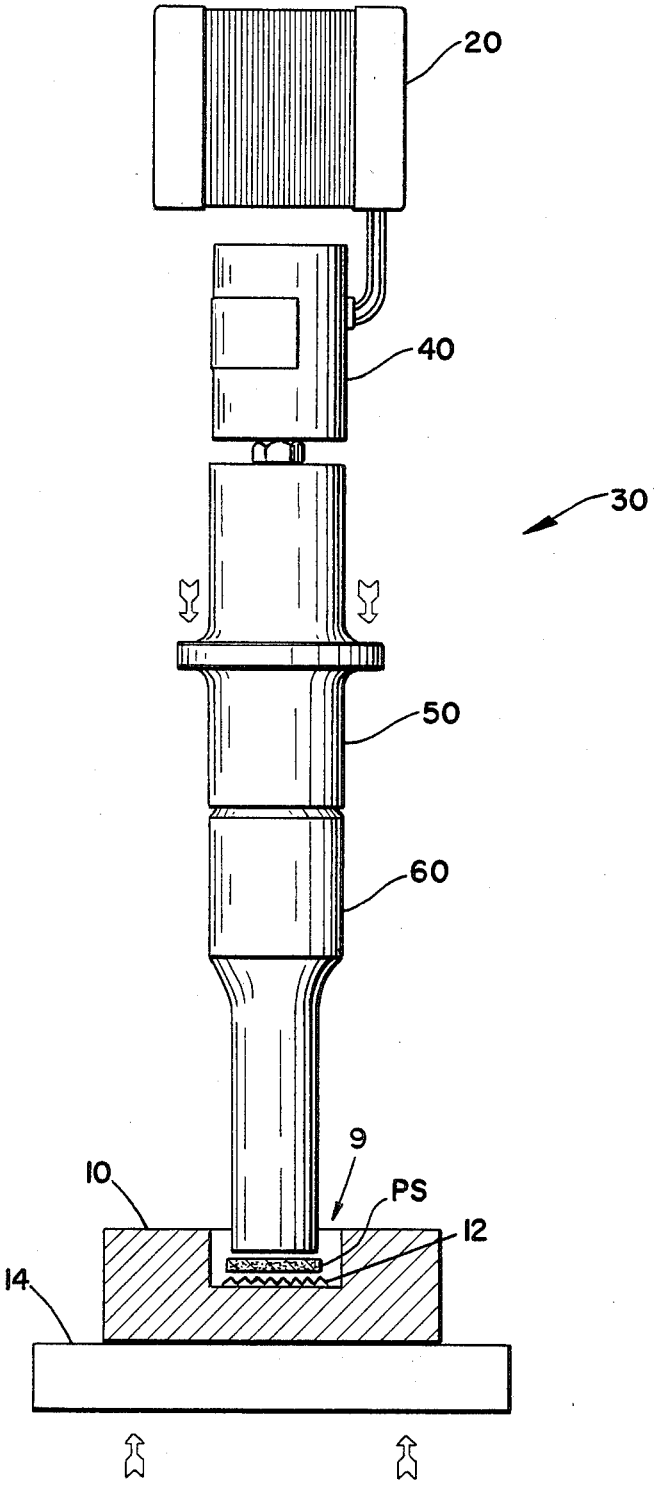
FIG. 1 is a fragmentary side elevational view of a device for simultaneously using pressure and heat (press-drying) and also applying ultrasonic energy to a sheet of paperboard, in accordance with the present invention.

It will be understood that certain elements may have been intentionally omitted from certain views where they are believed to be illustrated to better advantage in other views.

DESCRIPTION OF THE PREFERRED EMBODIMENTS

In the manufacture of paperboard, which consists substantially of cellulose fibres pressed and bonded together, it has always been the practice to use pressure to squeeze water from the fibre web and then apply heat to continue the process of water removal.

In recent years the concept of press-drying has been examined and tested. Press-drying is the name given to a new type of drying process for paper that combines the two steps of applying pressure and applying heat simultaneously to produce high-strength paperboard from relatively low-quality pulps. The process was originally developed at the Forest Products Laboratory of the U.S.D.A. Forest Service, and most of the research with press-drying has been conducted there. The significantly improved strength properties reported with press-drying are apparently obtained through improved fiber-fiber contact in the sheet. Claims are also made that adhesive bonding of hemicelluloses in the sheet contributes to this strength.

An original concept of press-drying was to produce a stronger paperboard with greater compressive strength using certain woods that could not be used in conventional paper making.

Although press-drying alone has merit, at its current state of technology it is not a high speed process, and, to be fully effective for strengthening, it must be applied when the paper or paperboard is in the 40%–20% moisture range.

Likewise, it is known that ultrasonic energy has been used for a variety of purposes, including limited dewatering of paper; however, ultrasonic energy has not been used in combination with press-drying in the production of paperboard.

It has been found that the use of ultrasonic energy in association with the press-drying process can achieve effects that cannot be readily obtained by conventional press-drying alone under the same conditions.

The mechanism through which water is removed from the wet web by presses is governed by the following factors: (1) the amount of pressure appllied, (2) the type of press (suction or plain), (3) the temperature of the water, and (4) the porosity of the wet web. The pressing action causes a lateral or sliding movement of the fibers from the high spots to the low spots of the sheet. This increases the surface smoothness and density of the sheet. Wet pressing also increases the fiber bonding and the compressive strength of the finished sheet.

Ultrasonic energy can be used to enhance the dewatering action of wet pressing by: (1) increasing the maximum dynamic pressure to which the web is exposed, (2) imitating the effects of a suction press on the wet web, (3) increasing the water temperature, and (4) imparting high frequency oscillatory motion to the individual fibers.

The increase in dynamic pressure on the wet web due to the effect of ultrasound is a function of the ultrasonic frequency used, the amplitude of vibration applied to the web, the density of the web, and the ultrasonic velocity in the web material. While the latter two factors are inherent properties of the web, the former two are controllable variables. For example, the dynamic pressure applied to the web can be increased, simply by increasing the vibration amplitude. This is done by applying more electrical power to the ultrasonic transducer.

In addition to the dynamic pressure, a static pressure gradient is also created in the medium due to the presence of the ultrasonic field. This effect is known as the ultrasonic radiation pressure. The radiation pressure gradient can be powerful enough to cause streaming of the water in the web. This streaming action is similar to the effect of a suction applied to the wet web. The magnitude of the pressure gradient is directly proportional to the intensity of applied ultrasound, a controllable parameter.

In most solids, especially high molecular weight components like lignin, a significant portion of the ultrasonic energy is absorbed and converted to heat. The heating rate is highly dependent on the ultrasonic frequency and on the viscoelastic properties of the web.

This effect acts to increase the water temperature and, hence, to also aid water removal.

The vibration imparted to the individual fibers by the ultrasonic field increases the lateral movement of fibers, producing a smoother sheet. The vibration also increases interfiber friction, which further increases the water temperature and promotes interfiber bonding. This also produces a stronger sheet. The effect of ultrasonics on interfiber bonding would primarily depend on the amount of lignin or other highly attenuating impurities remaining on the fibers at the press-drying stage. The effect of ultrasonics in promoting lateral fiber movement is most pronounced in a very wet or loosely compacted web.

Referring now to the drawings for a better understanding of the invention, in FIG. 1 there is illustrated the basic equipment necessary to provide ultrasonic press-drying of paperboard.

Figure 2:
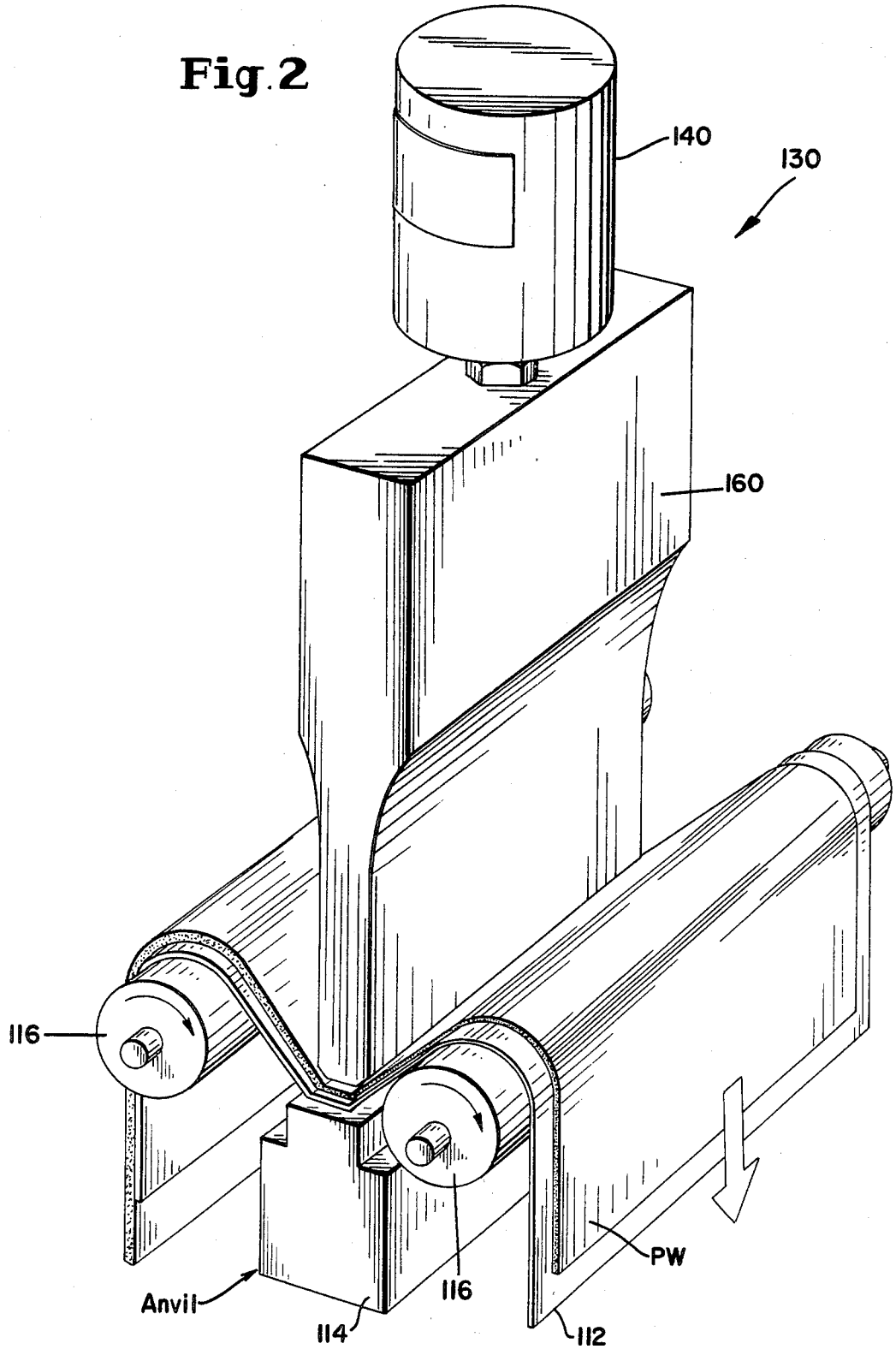
FIG. 2 is a fragmentary perspective view of a portion of a device for combining press-drying with the use of ultrasonics for the removal of moisture from a continuously moving web of paperboard.
Figure 3:
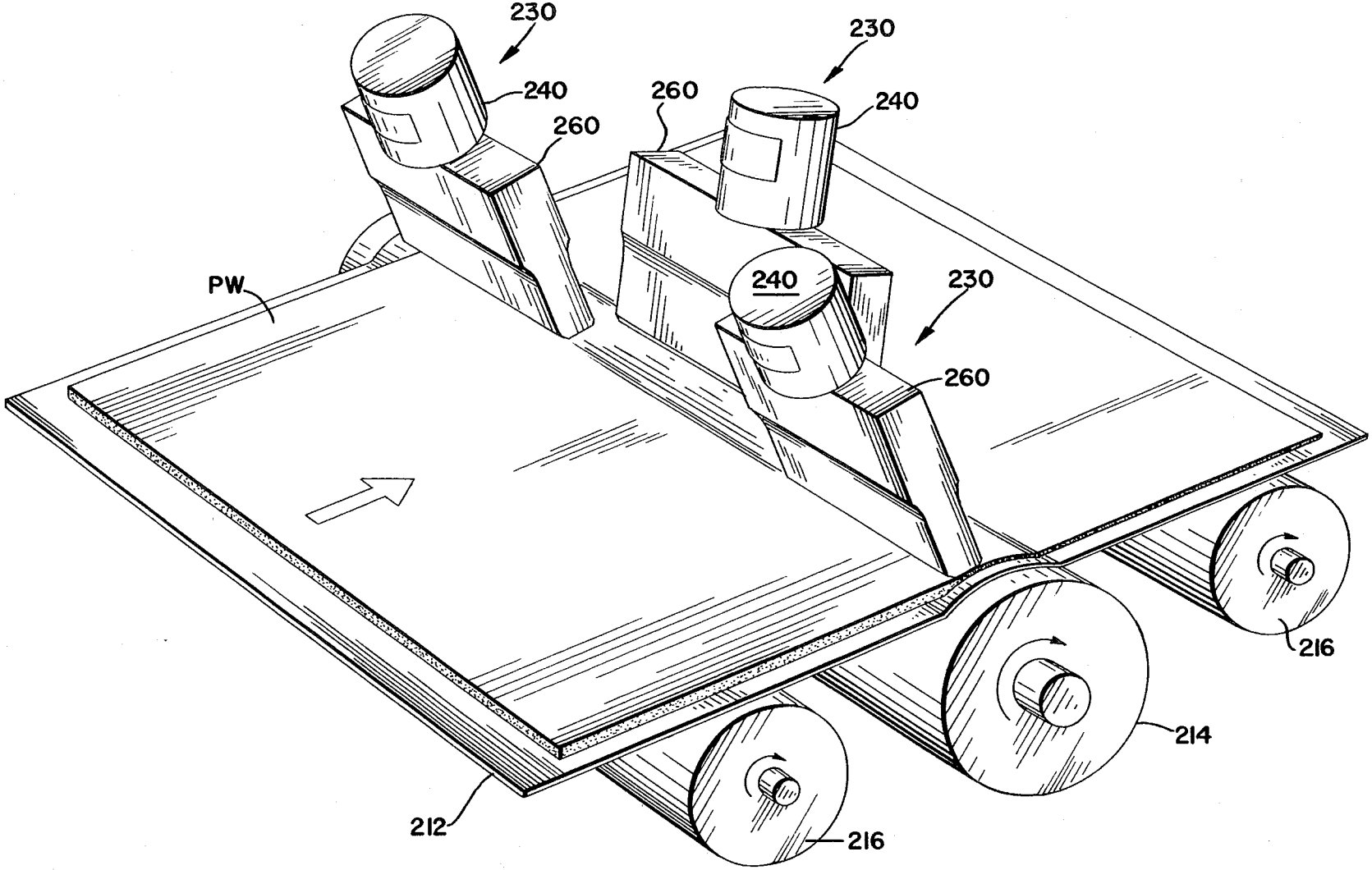
FIG. 3 is a view similar to FIG. 2, but illustrating a modified form of the invention.

The arrangement of FIG. 1 is primarily for applying the principles of the invention to sheets of paperboard; whereas the arrangements illustrated in FIGS. 2 and 3 are designed for applications of the invention to continuous webs of paperboard.

In FIG. 1, the paperboard, is in the form of a relatively small sheet indicated at PS.

The paperboard PS is positioned within the well 9 of a holder 10 over a wire screen 12. Holder 10 is in turn positioned on an anvil 14.

The function of the holder 10 is to support the paperboard under high pressure during treatment and to heat the paperboard to a temperature sufficient to achieve the desired dryness.

Positioned over the holder is the ultrasonic apparatus, which includes an ultrasonic applicator, an electrical power generator, and a force applicator, which can be a component of the ultrasonic applicator as hereinafter explained.

As best seen in FIG. 1, an electrical power generator, indicated generally at 20, is positioned above the paperboard, with the ultrasonic applicator interposed between the paperboard and the generator.

The function of the power generator 20 is to generate a high frequency, high power (1 kW) electrical signal to excite the ultrasonic transducer hereinafter described. It consists primarily of a lower power, 20 kHz oscillator, an electronic power amplifier, and an impedance matching transformer.

The function of the ultrasonic applicator is to convert electrical power into ultrasonic vibration and to transmit that vibration into the specimen.

The ultrasonic applicator indicated generally at 30 comprises three components; an ultrasonic transducer 40, an ultrasonic booster 50, and an ultrasonic horn 60.

The transducer 40 converts the high frequency electrical power signal from the generator 20 into a high frequency mechanical vibration. The booster 50 amplifies the mechanical vibration and transmits the vibration into the horn 60. The horn 60 amplifies the vibration again, helps to match the impedence of the ultrasonic source to the specimen, and couples the vibration into the specimen.

The ultrasonic horn 60 also acts as a force applicator to apply static pressure to the paperboard through a pneumatic cylinder or compression spring, not shown. The main function of the force applicator is to apply enough pressure to the paperboard to achieve press drying and to ensure good coupling between the paperboard and the ultrasonic applicator.

Pressure on the paperboard is applied from opposite directions, as indicated by the arrows in FIG. 1. The open or lower end of the horn is positioned in well 9 of holder 10 in direct contact with paperboard PS.

Referring now to FIG. 2, it will be seen that an arrangement different from that illustrated in FIG. 1 is shown.

The arrangement of FIG. 2, as well as that of FIG. 3, described later in the specification, is designed for the commercial application of ultrasonic energy in combination with press-drying to a continuously moving web of paperboard.

In FIG. 2, a continuous web of paperboard PW is supported, as it travels through the drying equipment, on a coarse screen web 112.

The screen and paperboard webs are disposed to ride over a fixed anvil 114 as they travel between a pair of spaced rollers 116. Positioned over the paperboard and screen webs is the ultrasonic horn 160 and transducer 140.

The details of the ultrasonic equipment are not shown or described in great detail as it can include standard, commercially available components.

The anvil may be heated, or the heat supplied to the paperboard through other means such as rollers 116.

Means, not shown in detail, may be provided to urge horn 160 toward anvil 114 to provide pressure on the paperboard web.

The operation of this arrangement is like that of the previously described arrangement, except that a continuously moving web of paperboard is subjected to press-drying and ultrasonic energy at the same time.

It should be understood that, although one ultrasonic horn is shown in FIG. 2, for a web of paperboard of normal width, many horns would be required as shown in FIG. 3.

Referring now to FIG. 3, another arrangement of the invention is shown that is slightly different from that illustrated in FIG. 2.

In this arrangement, the fixed anvil 114 of the previous arrangement has been replaced by a rotating anvil 214.

Again the continuously moving web PW of paperboard is supported on a screen web 212 over rollers 216. The ultrasonic horns 240 are urged against the paperboard web to force it against the rotating anvil 214 to produce pressure on the paperboard.

Again the paperboard can be heated through the anvil 214, by the rollers 216, or in any other desired manner so as to provide press-drying at the same time that the ultrasonic energy is applied to the paperboard.

Thus, it will be appreciated that the application of ultrasonic energy to paperboard during press-drying serves to enhance the drying and also cause the paperboard to be more dense than is the case when the paperboard is subjected to press-drying alone.

What is claimed is:

1. An improved method of treating a continuously moving web of newly formed paperboard to remove additional moisture and further compact the fibres of the paperboard comprising the steps of:

(a) press-drying said paperboard web by simultaneously subjecting it to pressure and heat;

(b) at the same time said paperboard web is being press-dried, applying ultrasonic energy directly to said paperboard web by passing said web snugly between an ultrasonic applicator and an anvil to apply heat and pressure to both sides of said web and also to cause vibration of said paperboard fibres.

2. Apparatus for treating a continuously moving web of newly formed paperboard to remove additional moisture and further compact the fibres of the paperboard, comprising:

(a) a continuously moving web of screen of substantially the same width as said paperboard web disposed adjacent and in alignment with said paperboard web for movement therewith;

(b) roller means for transporting and positioning said paperboard and screen webs together in generally parallel relation;

(c) a heated anvil disposed adjacent said screen web in engagement therewith throughout substantially the entire width of said screen web for heating said paperboard web;

(d) means for press-drying said paperboard web by applying pressure and heat thereto;

(e) an ultrasonic applicator device disposed adjacent said paperboard web opposite said anvil for compressing said web between said applicator device and said anvil, and for applying ultrasonic energy thereto at the same time said paperboard web is being heated.

3. Apparatus according to claim 2, wherein said ultrasonic device comprises at least one unit including:

(a) an electrical power generator;

(b) an ultrasonic applicator.

4. Apparatus according to claim 3, wherein said ultrasonic applicator includes:

(a) an ultrasonic transducer;

(b) an ultrasonic booster;

(c) an ultrasonic horn.

5. Apparatus according to claim 4, wherein said power generator includes:

(a) a low power oscillator;

(b) an electric power amplifier;

(c) an impedence matching transformer.

6. Apparatus according to claim 2, including a plurality of ultrasonic applicator devices arranged in side-by-side relation across said paperboard web.

7. Apparatus according to claim 2, and including means for moving said ultrasonic applicator toward said anvil to squeeze said paperboard therebetween.

8. Apparatus for treating a continuously moving web of newly formed paperboard to remove additional moisture and further compact the fibres of the paperboard, comprising:

(a) means for applying heat, pressure, and ultrasonic energy at the same time to said paperboard web;

(b) roller means for transporting said paperboard web past said applying means;

(c) said applying means including:

(i) an anvil member positioned immediately adjacent one side of said paperboard web;

(ii) an ultrasonic applicator member positioned immediately adjacent the other side of said paperboard web for applying ultrasonic energy directly to said web;

(d) means for moving one of said members toward the other to apply pressure to and thereby squeeze said paperboard web therebetween ultrasonic energy is applied thereto;

(e) means for applying heat to said paperboard web as said pressure and ultrasonic energy are being applied thereto.

9. Apparatus according to claim 8, wherein said anvil is heated to apply heat to said paperboard web.

10. Apparatus according to claim 8, whereinsaid roller means are heated to supply heat to said paperboard web.

* * * * *